US006181117B1

(12) United States Patent
Iafrate et al.

(10) Patent No.: US 6,181,117 B1
(45) Date of Patent: Jan. 30, 2001

(54) POWER SUPPLY CIRCUIT OF AN ELECTRONIC COMPONENT IN A TEST MACHINE

(75) Inventors: Gilles Iafrate, Chaponost; Jean-Pascal Mallet, Saint Priest en Jarez; Roland Petit, Saint Etienne, all of (FR)

(73) Assignee: Schlumberger Systemes, Paris (FR)

( * ) Notice: Under 35 U.S.C. 154(b), the term of this patent shall be extended for 0 days.

(21) Appl. No.: 09/367,376

(22) PCT Filed: Feb. 9, 1998

(86) PCT No.: PCT/FR98/00245

§ 371 Date: Oct. 25, 1999

§ 102(e) Date: Oct. 25, 1999

(87) PCT Pub. No.: WO98/36340

PCT Pub. Date: Aug. 20, 1998

(30) Foreign Application Priority Data

Feb. 13, 1997 (FR) ..... 97/01695

(51) Int. Cl.[7] ..... G05F 1/40
(52) U.S. Cl. ..... 323/269
(58) Field of Search ..... 323/269, 280, 323/281, 268

(56) References Cited

U.S. PATENT DOCUMENTS

| | | | | |
|---|---|---|---|---|
| 2,906,941 | * | 9/1959 | Brolin | 323/269 |
| 4,074,182 | * | 2/1978 | Weischedal | 323/269 |
| 4,338,658 | | 7/1982 | Toy | 363/72 |
| 4,618,779 | | 10/1986 | Wiscombe | 307/60 |
| 5,428,524 | | 6/1995 | Massie | 363/79 |
| 5,672,958 | * | 9/1997 | Brown et al. | 323/269 |
| 5,945,815 | * | 8/1999 | Elliot | 323/269 |

FOREIGN PATENT DOCUMENTS 0 059 089 9/1982 (EP) .

OTHER PUBLICATIONS

"Common Master and Slave Power Supplies", IBM Technical Disclosure Bulletin, vol. 34, No. 7B, Dec. 1, 1991, pp. 233–234, XP000282564—see entire document.

* cited by examiner

*Primary Examiner*—Shawn Riley
(74) *Attorney, Agent, or Firm*—Frishauf, Holtz, Goodman, Langer & Chick, P.C.

(57) ABSTRACT

Power supply circuit of an electronic component in a test machine and intended to provide the component with a supply current in a given range under a nominal polarization voltage. The power supply circuit includes two identical elementary circuits each able to provide a supply current in half the given range on respective output terminals thereof which are connected in parallel. The elementary circuits each include a regulation circuit for maintaining on the electronic component a polarization voltage equal to the nominal polarization voltage, and a power circuit which is controlled by the regulation circuit to provide the supply current in half the given range. The regulation circuit of a first elementary circuit also controls the power circuit of the second elementary circuit, the power circuit of the second circuit being disconnected from the regulation circuit of the second elementary circuit.

4 Claims, 2 Drawing Sheets

POWER SUPPLY CIRCUIT OF AN ELECTRONIC COMPONENT IN A TEST MACHINE

FIELD OF THE INVENTION

The present invention concerns a power supply circuit of an electronic component in a test machine.

The invention can be applied advantageously for tests, in production or determination of voltage vs. current characteristics, for example, for mixed CMOS components (analog/digital) with an extremely high integration scale, and more particularly those components functioning with high currents, such as microcontrollers or microprocessors.

BAKGROUND OF THE INVENTION

Generally speaking, an electronic component test machine is mainly made up of three elements:

- a computer which is the working station enabling an operator to prepare, using an appropriate software, the test sequences he intends to conduct on the electronic components, such as at the output of a production chain, so as to check its correct functioning;
- the core of a test machine, commonly known as an electronic bay, connected to the computer and which comprises a certain number of elements for generating the test sequence prepared by the operator and for comparing the responses obtained to those provided in advance in the context of a conforming functioning of the components, and
- a measuring head for housing the electronic components to be tested.

Moreover, the electronic bay includes a direct current supply sub-unit formed of as many power supply circuits as needed for supplying power to the components to be tested. Each power supply circuit is intended to provide the electronic component in question with a direct supply of current from a given range under a nominal polarization voltage, such as +5V. Depending on the type of components to be tested, there are various current ranges characterizing the power supply circuits: there are circuits with an extremely weak current in the range of 0 to 0.5 A, low current circuits with current in the range of 0.5 to 4 A, high current circuits with current in the range of 4 to 30 A, and very high current circuits with current in the range of 30 to 60 A.

The power supply circuits currently used having a given range are made up of two identical elementary circuits able to provide under the same nominal polarization voltage a direct current of half the given range, the output terminals of said elementary circuits being connected electrically in parallel and the current applied to the electronic components to be tested. For example, so as to obtain a power supply circuit with a range having an 8 A maximum, it is thus possible which are to place two elementary circuits in parallel low current circuits each having a range with a 4 A maximum.

More specifically, each elementary power supply circuit firstly includes a regulation circuit intended to ensure that the voltage effectively applied to the component is always equal to the nominal polarization voltage, and secondly a power circuit controlled by said regulation circuit whose designated aim is to provide a direct current of half the given range, the total current being the sum of the currents provided by the two elementary circuits, namely in principle double the current provided by each of them.

However, this type of assembly where the two elementary power supply circuits are completely independent does have a certain number of drawbacks.

Firstly, on static functioning, the two elementary power supply circuits are independent regulation circuits which, owing to dispersions of various origins (components, cable length to the measuring head), do not adjust the polarization voltage identically and this causes an erratic functioning of one circuit with respect to the other possibly leading to a situation where an elementary power supply circuit delivers a current into the other elementary power supply circuit with the risk of destroying the other elementary power supply circuit by means of thermal runaway without this malfunctioning being noticed by the user.

Secondly, on dynamic functioning, the presence on each regulation circuit of an independent compensation network with the decoupling capacitor placed on the supply pin of the component being tested can cause uncontrolled frequency stability problems due to the disparity between the two compensation networks. As a result, polarization voltage oscillations may occur and become unacceptable owing in particular to risks of excess heating of the component.

This difficulty linked to balancing between the two elementary circuits is much more sensitive when it is sought to embody power supply circuits needing to function within a range of extremely high currents extending up to 60 A. In fact, owing to the extremely high level of integration reached today, the present trend is to obtain a reduction of the nominal polarization voltage, namely a consequence of a reduction of the size of the components, and also an increase of the runaway current, namely a consequence of increasing their number.

One solution to embody a power supply circuit with an extremely high current would be to only use a single circuit with a single adjustment and a single power circuit. In fact by its very definition, no problem of balancing between elementary circuits could occur. However, other difficulties would appear, especially as regards connectors, as it would be necessary to be able to simultaneously use a larger number of pins. In addition, as the link with the component to be tested is effected over a large distance, namely about 6 meters, so as to avoid a significant ohmic fall occurring, it would be necessary to use a large diameter cable, which is incompatible as regards questions of spatial requirements in relation to existing installations. Finally, components functioning under extremely high power do pose significant cooling problems.

SUMMARY OF THE INVENTION

The solution offered by the invention is to use two elementary power supply circuits, as in the prior art previously described, provided however that the problems concerning balancing by the presence of two independent elementary circuits are resolved.

To this effect, one aspect of the present invention provides a power supply circuit of an electronic component in a test machine and intended to provide said component with a direct supply current from a given range under a nominal polarization voltage, said power supply circuit including two identical elementary power supply circuits, each able to provide on an output terminal a direct supply current from half the given range under said nominal polarization voltage, said output terminals being connected in parallel at the tested electronic component, said elementary power supply circuits each comprising:

- a regulation circuit for maintaining on the electronic component a polarization voltage equal to the nominal polarization voltage,
- a power circuit adapted to be controlled by said regulation circuit and for providing said direct supply current from half the given range, this arrangement being characterized in that the regulation circuit of a first elementary power supply circuit known as the master circuit also controls the power circuit of the second elementary power supply circuit known as the slave circuit, the power circuit of said slave circuit being disconnected from the regulation circuit of the same slave circuit.

Thus, the adjustment of the polarization voltage is ensured by a single adjustment circuit, namely that of the master circuit. Thus, the causes of static and dynamic instability mentioned earlier are eliminated. Of course, so as to obtain a perfect sharing of the current between the master and slave circuits, it is essential that the power circuits are as identical as possible and that the gain, offset and thermal shift between the two circuits are as small as possible with respect to the balance sought between the currents. Note that if a significant variation occurs at a given moment, such as a current variation, this would be equally supported by the two circuits.

It is also necessary to observe that even if the two elementary circuits do not play a symmetrical role, they are nevertheless identical, which allows for a standardization of production of the corresponding cards which may derive from either slave or master circuits.

Finally, according to one advantageous characteristic of the power supply circuit of the invention, each elementary power supply circuit comprising at least one circuit for measuring the direct supply current from half the range, the current measured by the slave circuit is added to the current measured by the master circuit with the aid of an adder of the master circuit.

In this way, it is possible to obtain a direct measurement of the current delivered by the power supply circuit, whereas in the prior art it was necessary to successively read the values of the current measured by each circuit and then carry out addition on the computer. This results in obtaining a significant gain in time.

BRIEF DESCRIPTION OF THE DRAWINGS

The following description in relation to the accompanying drawings given by way of non-restrictive examples shall disclose details of the invention and on how it can be embodied.

DETAILED DESCRIPTION OF THE INVENTION

Figure 1:
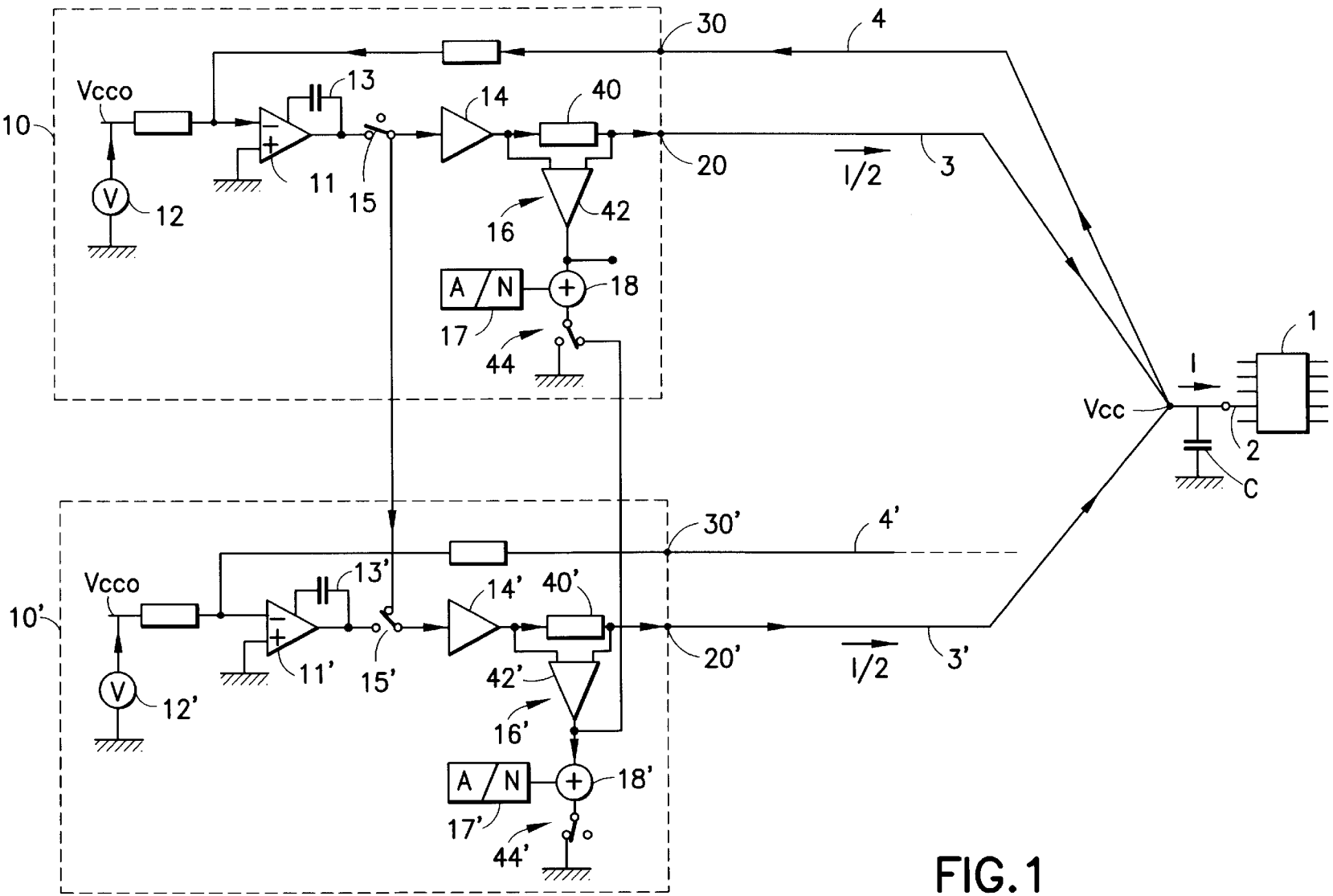
FIG. 1 is a diagram of a power supply circuit conforming to the invention.

The diagram of FIG. 1 represents the power supply circuit included in an electronic bay (not shown) for an electronic component 1 placed in a test machine. Said component 1 is placed on the measuring head of the machine which is connected to the electronic bay by cables 3, 3' whose length may be about 6 meters.

The power supply circuit of FIG. 1 is intended to apply to a supply pin 2 a polarization voltage Vcc which needs to be kept equal to a nominal polarization voltage Vcco equal, for example, to +5V. Secondly, said power supply circuit needs to be able to provide the component 1 with a direct supply current I whose value depends on the functioning mode of the component, such as the stand-by mode, slight consumption mode or the working mode in which the current may reach extremely high values of up to 60 A which defines the range of current from the power supply circuit.

As shown on FIG. 1, the power supply circuit of the invention includes two identical elementary power supply circuits 10, 10' for providing on a respective output terminal 20, 20' a direct I/2 supply current half the given range, such as 30 A, under said nominal polarization voltage Vcco. To this effect, each elementary power supply circuit 10, 10' comprises a regulation circuit 11, 11' for maintaining on the component 1 being tested a polarization voltage Vcc equal to the voltage Vcco. Having regard to the length, about 6 meters, of the supply cables 3, 3', it can be readily understood that the voltage Vcc effectively applied to the pin 2 can vary, especially according to the value of the current I. Voltage adjustment is generally carried out by applying to an input terminal 30, 30' of the circuits 10, 10' the voltage Vcc taken from the electronic component 1 by a measuring line 4, 4', the terminals 30, 30' being connected to an input of the regulation circuit 11, 11' to which the nominal polarization voltage Vcco is applied provided by a voltage generator 12, 12'. Note the presence on the regulation circuits 11, 11' of a capacitive network 13, 13' for compensating the uncoupling capacitor C placed in parallel on the supply pin 2 of the component 1.

However, so as to avoid any instability which would cause an independent adjustment of the polarization voltage Vcc by each of the circuits 11, 11', as can be seen on FIG. 1, it would be an advantage for the regulation circuit 11 of the elementary circuit 10, called the master circuit, to perform this adjustment function. This is why the regulation circuit 11 controls both the power circuit 14 of the master circuit 10 and the power circuit 14' of the second elementary circuit 10', known as the slave circuit. With this aim in mind, electronically controlled switches 15, 15' are inserted between the regulation circuits 11, 11' and the power circuits 14, 14' so that the output of the regulation circuit 11 is simultaneously connected to the inputs of the two power circuits 14, 14', the power circuit 14' of the slave circuit 10' then being disconnected from the corresponding regulation circuit 11'. As the regulation circuit 11' is out of action, the measuring line 4' may or may not be connected to the supply pin 2 of the electronic component 1 being tested.

FIG. 1 also shows that the master 10 and slave 10' circuits are fitted with measuring circuits 16, 16' for measuring the I/2 supply current passing through resistors 40, 40'. Operational amplifiers 42, 42' measure the voltages across resistors 40, 40', respectively, and output an analog signal related to the current I/2. The measured value of this current is available in a analog/digital converter 17, 17' of each circuit. However, rather than successively reading the values in each converter and then have the computer of the test machine carry out the calculation, it is preferable, as shown on FIG. 1, that the current measured by the slave circuit 10' is added to the current measured by the master circuit 10 by means of the adder 18 of the master circuit 10. Electronically controlled switches 44, 44' are controlled so that switch 44 directs the output of measuring circuit 16' to an input of adder 18 while switch 44' connects an input of adder 18' to ground. Of course, the slave circuit 10' also comprises an unused adder 18' pursuant to the principle that even if they do not play a symmetrical role, the slave and master circuits are completely identical for reasons of standardization.

Figure 2:
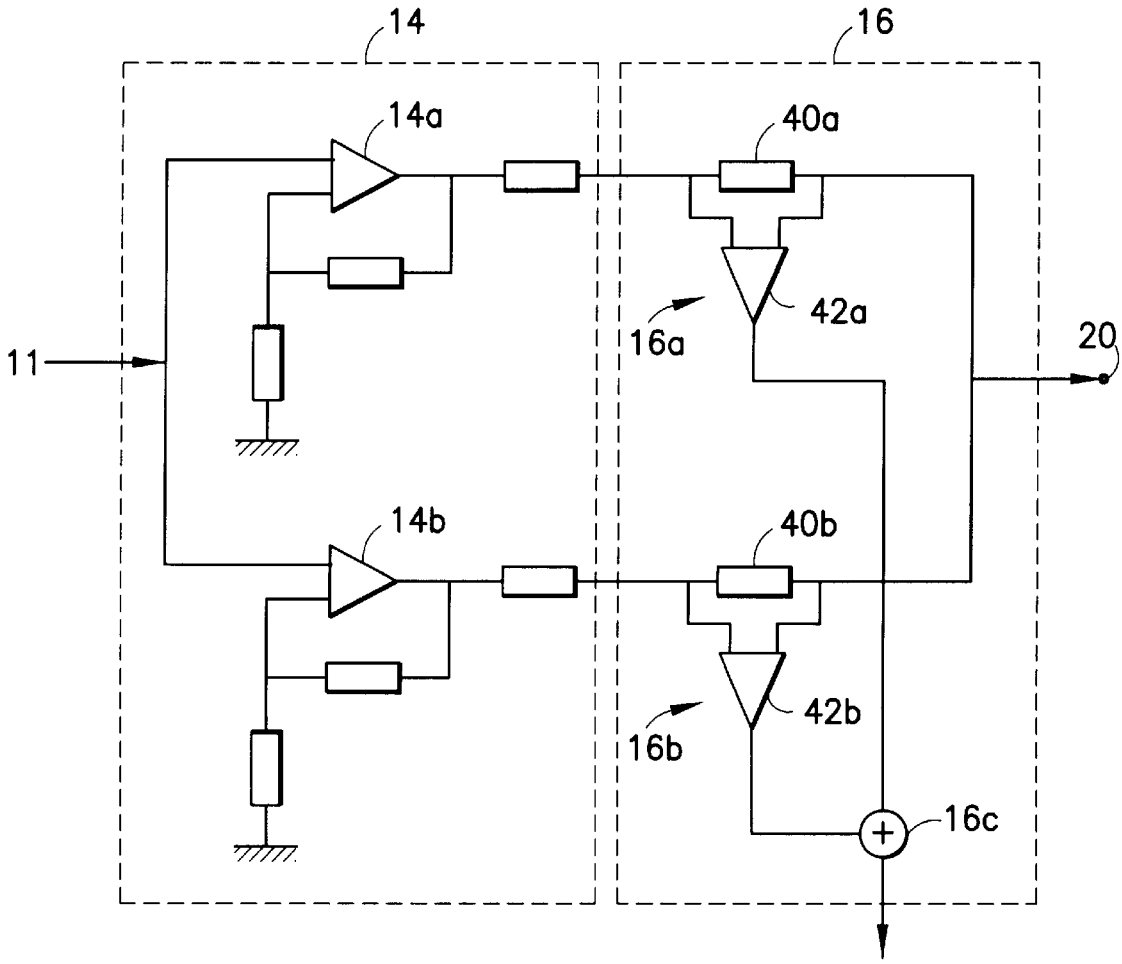
FIG. 2 is a diagram of a power circuit and a measuring circuit of the power supply circuit of FIG. 1.

As mentioned earlier, the arrangement of FIG. 1 is particularly advantageous for embodying a power supply circuit with a range having a 60 A maximum from power circuits 14, 14' each having a range with a 30 A maximum which in turn can be embodied by placing in parallel two amplifiers 14*a*, 14*b* each having a range with a 15 A maximum shown on FIG. 2 for the circuit 14. Of course, these two power amplifiers need to have identical characteristics (gain, offset), and equally their possible temperature drifts also need to be identical. This is why the amplifiers 14a, 14b are mounted on the same heat dissipator (not shown).

Correspondingly, FIG. 2 shows that in this case, the measuring circuit 16 is made up of two partial measuring circuits 16*a,* 16*b* whose outputs are added by an adder 16*c.*

We claim:

1. Power supply circuit of an electronic component (1) in a test machine to provide said component with a direct supply current from a given range under a nominal polarization voltage (Vcco), said power supply circuit including a master circuit and a slave circuit respectively including identical elementary supply circuits each able to provide on an output terminal (20, 20') a direct supply current from a half range under said nominal polarization voltage, said output terminals (20, 20') being coupled in parallel to the level of the electronic component being tested, said elementary supply circuits each including:

a regulation circuit (11, 11') for maintaining on the electronic component a polarization voltage (Vcc) equal to the nominal polarization voltage (Vcco), a power circuit (14, 14') controlled by said regulation circuit (11, 11') to provide said direct supply current from said half range, wherein the regulation circuit (11) of the master circuit also being coupled to the power circuit (14') of the slave circuit, with the power circuit (14') of said slave circuit being disconnected from the regulation circuit (11') of the same slave circuit.

2. Power supply circuit according to claim 1, wherein, as said given range is the 60 A range, the two elementary supply circuits (10, 10') from the 30 A range are each embodied via the placing in parallel of two 15 A power amplifiers (14*a,* 14*b*) mounted on a given heat dissipator.

3. Power supply circuit according to claim 1, wherein as each elementary supply circuit (10, 10') comprises at least one direct current supply measuring circuit (16*a,* 16*b*) from the half range, the current measured by the slave circuit (10') is added to the current measured by the master circuit (10) by means of an adder (18) of the master circuit.

4. Power supply circuit according to claim 2, wherein as each elementary supply circuit (10, 10') comprises at least one direct current supply measuring circuit (16*a,* 16*b*) from the half range, the current measured by the slave circuit (10') is added to the current measured by the master circuit (10) by means of an adder (18) of the master circuit.

* * * * *